US005425005A

United States Patent [19]

Urabe et al.

[11] Patent Number: 5,425,005

[45] Date of Patent: * Jun. 13, 1995

[54] DRIVE UNIT FOR A ROTARY DECORATION

[75] Inventors: Takuo Urabe; Yukari Hoshino, both of Tokyo, Japan

[73] Assignee: Seikosha Co., Ltd., Japan

[ * ] Notice: The portion of the term of this patent subsequent to Mar. 28, 2012 has been disclaimed.

[21] Appl. No.: 36,035

[22] Filed: Mar. 23, 1993

[30] Foreign Application Priority Data

Mar. 23, 1992 [JP] Japan ..... 4-065108
Mar. 23, 1992 [JP] Japan ..... 4-065109
Mar. 23, 1992 [JP] Japan ..... 4-065110

[51] Int. Cl.[6] ..... G04B 17/02; G04B 17/10
[52] U.S. Cl. ..... 368/180; 368/134
[58] Field of Search ..... 368/134, 180

[56] References Cited

U.S. PATENT DOCUMENTS 4,482,260 11/1984 Fehrenbacher ..... 368/180

*Primary Examiner*—Bernard Roskoski
*Attorney, Agent, or Firm*—Adams & Wilks

[57] ABSTRACT

A drive unit for a rotary decoration has a transmission gear train configured to include a damper such as a coil spring and is capable of imparting a visually elegant swing motion to the rotary decoration. A reciprocating stepping motor is capable of rotating or turning in both the forward and reverse directions to drive a rotary decoration in such a manner that the rotary decoration exhibits a reciprocative swing motion over a specified angular displacement. A memory circuit stores data for determining the drive timing of the stepping motor. A control circuit controls the stepping motor in accordance with the data stored in the memory circuit. The data represents the interval between drive pulses supplied to the stepping motor so as to cause the rotational speed of the rotary decoration to vary according to a sine curve. In alternative embodiments, (1) the intervals between drive pulses are set to a uniform and short value in a predetermined region of the specified angular displacement; (2) the intervals between drive pulses are set to a short value in a predetermined region of the specified angular displacement which corresponds to the location immediately after which the rotational direction of the rotary decoration is reversed; and (3) the drive pulses are blanked over a predetermined region corresponding to the location immediately before the rotational direction of the rotary decoration is reversed.

18 Claims, 10 Drawing Sheets

DRIVE UNIT FOR A ROTARY DECORATION

BACKGROUND OF THE INVENTION

The present invention relates to a drive unit for a rotary decoration used, for example, in a table clock.

A popular, highly decorative and fashionable clock is a table clock having a rotary decoration. A rotary decoration constituting the primary decorative component of such a table clock is usually mounted rotatably or turnably on a vertical member or shaft, so as to undergo a swing movement about the vertical shaft in a horizontal direction. A hair spring or a motor is used for causing a reciprocative swing movement of the rotary decoration.

One example of a prior art driving means for a rotary decoration is a hair spring, which is constituted in such a manner that a rotary decoration is supplied a reciprocative swing movement by the application of the balance-wheel motor principle used in a transistor clock, while its rotational shaft is driven Via the hair spring to cause a moderate sine curve, thus imparting an elegant motion to the rotary decoration. Japanese Utility Model Publication No. 21821 (1985) discloses such a clock.

However, the hair spring type rotary decoration is disadvantageous in that it involves a complicated design and manufacturing process and, therefore, is not suited for mass production. Furthermore, the cost of parts is high. This type of rotary decoration is also troublesome to install, since careful attention is required in installing the hair spring.

As another example of a driving means for a rotary decoration, the present inventors have developed a stepping motor for a rotary decoration which is disclosed in Japanese Patent Application No. 43718 (1991). This stepping motor is capable of rotating or turning in both the forward (normal) and reverse directions, and the drive timing of the motor is controlled in such a manner that the rotary decoration exhibits a reciprocative swing movement on the same sine curve as in the case of the hair spring type.

The drive unit using the reciprocating stepping motor described in the second example uses a damper, such as a coil spring, in the transmission gear train so that a smooth rotational motion can be obtained in the decoration regardless of the characteristics of the stepping motor. However, this arrangement has the following three problems:

(1) In order to speed up the rotation period without varying the maximum swing angle $\theta 1$, it is normally required to reduce the interval d of an output pulse used to drive the stepping motor. In other words, it is required that the pulse interval d be shortened so that numerous drive pulses can be generated within a short period of time. In view of the physical characteristics of the stepping motor, the minimum pulse interval $d_{min}$ is restricted to a predetermined value. Therefore, the maximum pulse interval $d_{max}$ must be made smaller.

If the maximum pulse interval $d_{max}$ is reduced to a smaller value while $d_{min}$ is limited to its predetermined minimum value, the difference between the maximum pulse interval $d_{max}$ and the minimum pulse interval $d_{min}$ becomes small. Hence, the difference between the angular velocity $\omega_{max}$ of the rotary decoration during low-speed rotation and the angular velocity $\omega_{min}$ of the rotary decoration during high-speed rotation likewise becomes small. Thus, there is no crispness in the rotation of the rotary decoration.

Furthermore, if the maximum pulse interval $d_{max}$ is reduced to a smaller value, the angular velocity $\omega$ cannot be sufficiently reduced when the rotary decoration changes its rotational direction. Namely, the rotary decoration starts to move fast from the beginning. As a result, the motion of the rotary decoration looks visually awkward. Therefore, there is a problem in the prior art wherein the desired elegant swing movement of the rotary decoration cannot be achieved.

Moreover, if numerous drive pulses are generated within a limited short period of time, electric power consumption increases, and the life of the battery is thus shortened.

(2) When the rotary decoration changes its rotational direction, a coil spring is wound up. At the beginning of this winding operation, the rotary decoration is stopped for a period, due to the fact that the coil spring is unwound, and then wound up again. Accordingly, it is not possible to impart the desired elegant swing movement to the rotary decoration.

(3) Even if the application of the drive pulses for the stepping motor is suddenly terminated, the wound-up coil spring is gradually loosened. Therefore, the spring force stored in the coil spring is gradually transferred to the rotary decoration. Thus, the rotary decoration continues to rotate for a time due to its inertia.

Accordingly, even if a drive pulse is suddenly outputted to cause the stepping motor to rotate in the reverse direction in an attempt to reverse the rotational direction of the rotary decoration, the rotary decoration maintains its current rotational direction for a period of time by virtue of its inertia. As a result, the rotational driving force of the stepping motor and the inertia derived from the coil spring acting in the reverse direction interfere with each other. Thus, irregularities arise in the motion of the rotary decoration.

SUMMARY OF THE INVENTION

A main object of the present invention is to provide a drive unit for a rotary decoration which overcomes the above-described problems and disadvantages associated with the prior art.

Another object of the present invention is to provide a drive unit for a rotary decoration which is capable of achieving an elegant swing movement, even if a damper, such as a coil spring, is used in the transmission gear train.

In order to accomplish these objects, the present invention provides a drive unit for a rotary decoration comprising turning means, such as a stepping motor, capable of rotating or turning in both the forward and reverse directions in response to drive pulses supplied from driving means such as a motor driving circuit. The stepping motor is operable to drive a support member supporting a rotary decoration in such a manner that the rotary decoration is driven in a reciprocative swing motion. Storing means, such as a memory circuit, stores timing data determinative of a drive timing associated with the stepping motor. Control means, such as a control circuit, is provided for controlling the stepping motor in accordance with the timing data stored in the memory circuit. The timing data comprises numerical values corresponding to pulse intervals between drive pulses applied to the stepping motor, the numerical values being determined such that the rotational speed of the rotary decoration varies according to a sine curve.

In a first embodiment of the invention, the pulse intervals between drive pulses in the middle region of one unidirectional turn of the rotary decoration are short and equally spaced.

In a second embodiment, the pulse intervals between drive pulses applied just after a change in the rotational direction of the rotary decoration are short over a fixed region.

In a third embodiment, the data causes a blank pulse portion to exist over a fixed region immediately before the turning or rotational direction of the rotary decoration is changed.

DETAILED DESCRIPTION OF THE INVENTION

Figure 1:
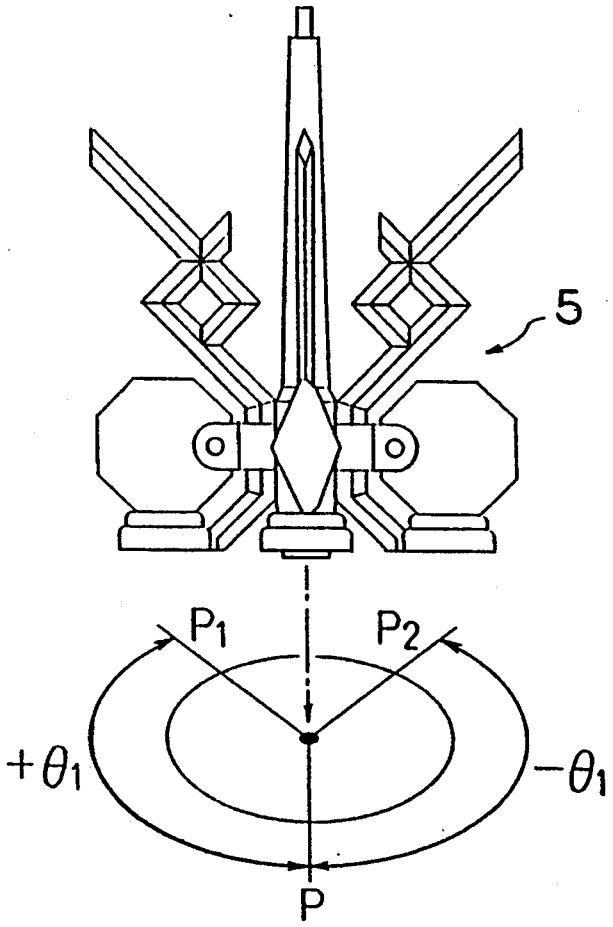
FIG. 1 is an explanatory view showing the relationship between a rotary decoration and its rotational angle in accordance with the present invention.

A first embodiment of the present invention will now be described with reference to the accompanying drawings.

An object of present invention is to control the operation timing of the stepping motor which drives a rotary decoration, in order to cause the output shaft to realize a moderate speed change so as to emulate the operation of a rotary decoration which swings by the use of a hair spring. The moderate speed change of the rotary decoration will be explained with reference to FIG. 1.

The front of a rotary decoration 5 is oriented so as to face a point P. The rotary decoration 5 rotates or turns in a clockwise direction by an angle of $+\theta_1$ until it reaches a point $P_1$, and then reverses its rotational direction (i.e., rotates in a counterclockwise direction) to return from the point P1 to the point P. The rotary decoration 5 further rotates in the counterclockwise direction by an angle of $-\theta_1$ until it reaches a point $P_2$. In this manner, the rotary decoration 5 exhibits a reciprocative swing motion having a cycle reciprocating between the three points P1, P, and P2 in a sequence of P→P1→P→P2→P→ . . .

By causing the stepping motor to change its speed according to a cosine curve having a predetermined period, it is possible to change the speed of the rotary decoration driven by the stepping motor in such a manner that the rotary decoration changes its speed according to a sine curve.

To cause such a speed change, the drive pulse interval d between drive pulses used to drive the stepping motor is reduced as the angular velocity $\omega$ of the rotary decoration becomes large. Conversely, when the angular velocity $\omega$ of the rotary decoration is small, the drive pulse interval d is increased to a large value (see FIG. 2).

However, in the case where the rotary decoration 5 is controlled to swing according to a sine curve, its transmission gear train is configured to include a damper member, such as a coil spring, in order to realize a smooth swing motion of the rotary decoration even if it is driven by a stepping motor.

In such a case, in order to speed up the rotation period without varying the maximum swing angle $\theta_1$, it is normally necessary to reduce the interval d of the output drive pulse used for driving the stepping motor. In other words, it is necessary to shorten the pulse interval d between drive pulses so that numerous pulses can be generated within a limited period of time.

In view of the physical characteristics of the stepping motor, the minimum pulse interval $d_{min}$ is restricted to a predetermined value. Therefore, the maximum pulse interval $d_{max}$ must be made smaller.

As stated above, if the maximum pulse interval $d_{max}$ is reduced to a smaller value, the difference between the maximum pulse interval $d_{max}$ and the minimum pulse interval $d_{min}$ becomes small. Hence, the difference between the angular velocity $\omega_{max}$ of the rotary decoration during low-speed rotation and the angular velocity $\omega_{min}$ of the rotary decoration during high-speed rotation likewise becomes small. Thus, variance in the rotation of the rotary decoration disappears.

Furthermore, as stated above, if the maximum pulse interval $d_{max}$ is reduced to a smaller value, the angular velocity $\omega$ cannot be sufficiently reduced when the rotary decoration changes its rotational direction. That is, the rotary decoration begins to move fast from the beginning of its movement. As a result, the motion of the rotary decoration appears visually awkward.

Moreover, if numerous pulses are generated within a short period of time, electric power consumption increases and the life of the battery is shortened.

In order to solve these problems, the angular velocity is accelerated before and decelerated after the rotary decoration 5 initiates its rotational movement and before and after the rotary decoration 5 stops its rotational movement, to drive the rotary decoration at a constant speed at the region where the rotary decoration rotates at its maximum speed, i.e., when it passes the middle region or mid-point of its swing movement in one rotational direction.

Figure 3:
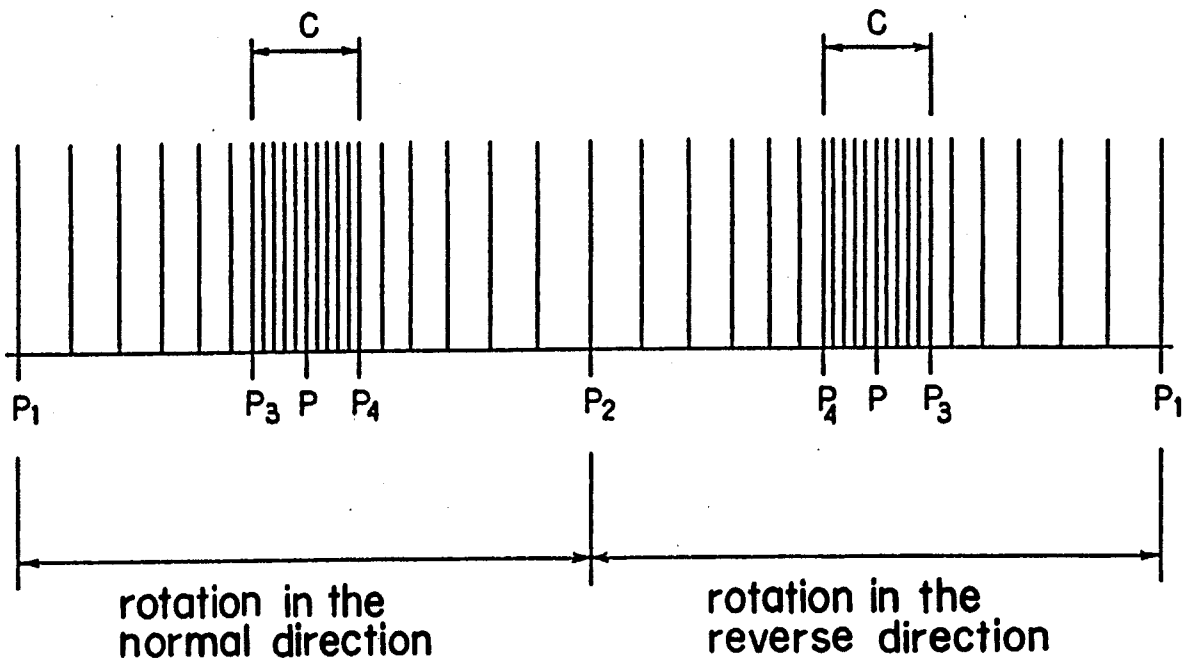
FIG. 3 is a waveform chart showing drive pulses in accordance with a first embodiment of the present invention.

In accordance with a first embodiment of the present invention, as shown in FIG. 3, drive pulses are applied at small, equal intervals within a predetermined region C encompassing the middle region of the swing range of the rotary decoration in one direction.

Figure 4:
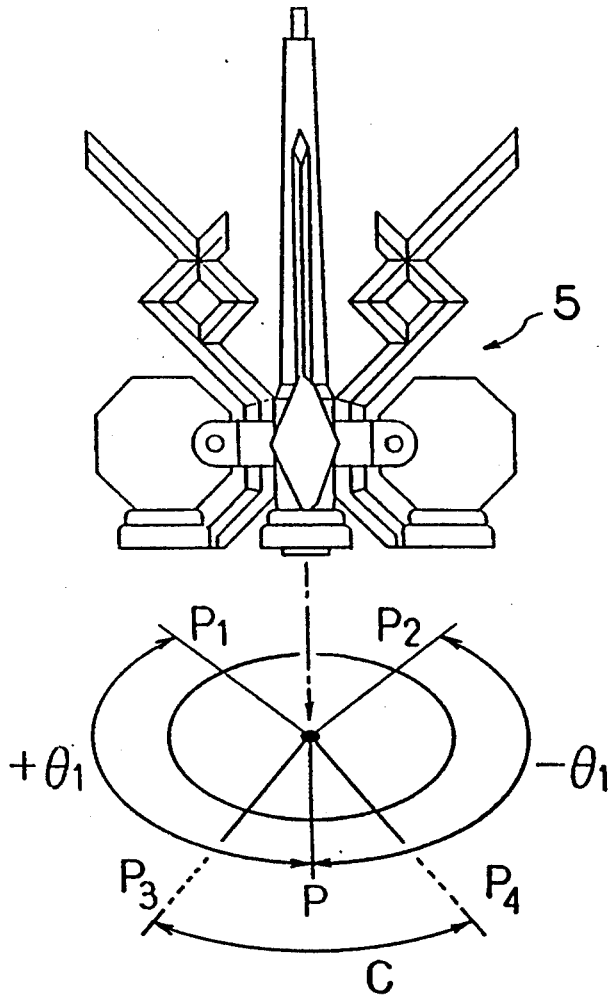
FIG. 4 is an explanatory view showing the relationship between the rotary decoration member and its rotational angle.

By adopting the pulse waveform shown in FIG. 3, the rotary decoration 5 is gradually accelerated in the direction of its normal rotation, and is driven at a constant speed in the middle region (i.e., a region between points $P_3$ and $P_4$ shown in FIG. 4), and is gradually decelerated after passing the middle region until point $P_2$ is reached.

Next, drive pulses for driving the stepping motor in the reverse direction are outputted and reverse rotation begins. In accordance therewith, the rotary decoration 5 is gradually accelerated in the direction of its reverse rotation, driven at a constant speed in the middle region (i.e., the region between points $P_3$ and $P_4$ in FIG. 4), and then gradually decelerated after passing the middle region until point $P_1$ is reached. This behavior continues in a repetitive manner.

Figure 2:
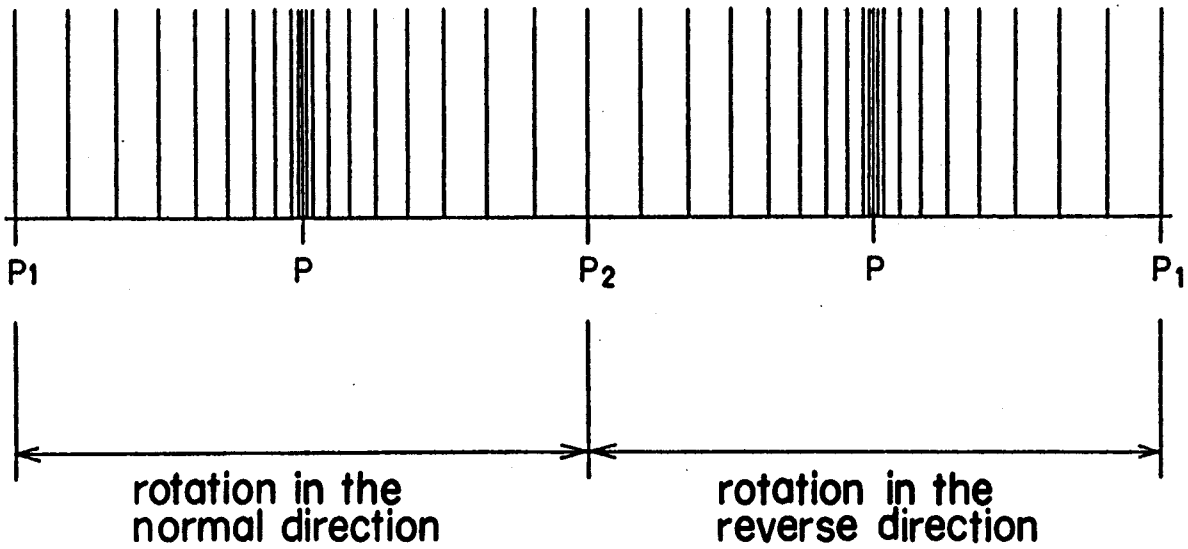
FIG. 2 PRIOR ART
FIG. 2 is a waveform chart showing drive pulses in the conventional rotary decoration motor.

As described above, in the case where the pulse waveform shown in FIG. 2 is adopted, the rotary decoration 5 is gradually accelerated at the beginning of its swing motion in the forward direction and is gradually decelerated once it passes a central point (i.e., the point P in FIG. 1).

However, in a case where the pulse waveform shown in FIG. 3 is adopted, the rotary decoration 5 can be decelerated within a smaller region, i.e., from a point just beyond where the rotary decoration has passed the middle region to the apogee of rotation (i.e., a region from the point $P_4$ to the point $P_2$, or a section from the point $P_3$ to the point $P_1$).

Therefore, it becomes possible to complete the deceleration within a short period of time and, therefore, the rotary decoration 5 obtains a visually elegant swing motion.

Next, a second embodiment of the present invention is explained with reference to the accompanying drawings.

Conventionally, as mentioned above, the coil spring is wound up when the rotary decoration 5 changes its rotational direction. That is, in FIG. 4, the coil spring is wound when the rotary decoration 5 rotates in a clockwise direction by an angle of $+\theta_1$ until it reaches the point $P_1$, to then reverse its rotational direction (i.e., to rotate in a counterclockwise direction) to return from the point $P_1$ to the point P. The rotary decoration 5 stops its rotational motion during the period of time required for loosening the wound coil spring and for re-winding the coil spring. As a result, it becomes impossible to impart an elegant swing motion to the rotary decoration 5.

Figure 5:
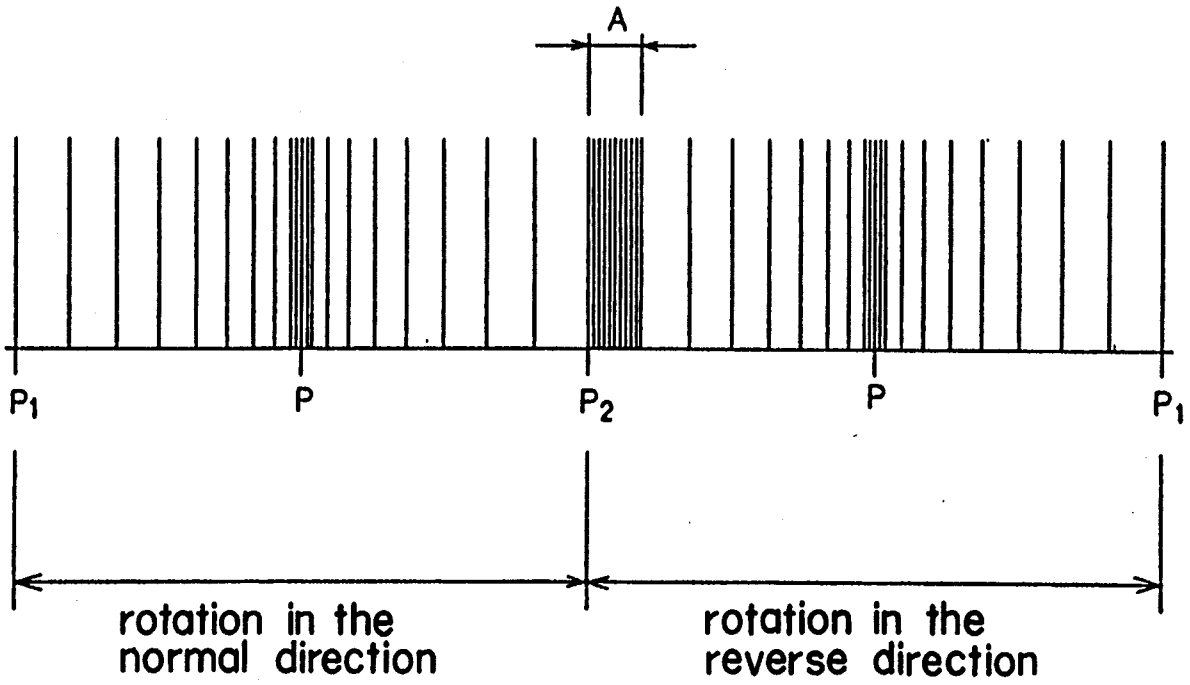
FIG. 5 is a waveform chart showing drive pulses in accordance with a second embodiment of the present invention.

In order to solve such a problem, in accordance with a second embodiment of the present invention, as shown in FIG. 5, the duration of the pulse intervals becomes short over a predetermined region A immediately after the rotary decoration has changed its rotational direction. That is to say, by outputting drive pulses over a short period of time in the amount required to loosen the wound coil spring and then re-wind it, it becomes possible to promptly wind up the coil. As a result, the rotary decoration 5 is prevented from stopping at the time when the rotational direction of the rotary decoration 5 is changed. Thus, an elegant swing movement is realized.

Next, a third embodiment of the invention is explained with reference to the drawings.

As stated above, even if the application of drive pulses to the stepping motor is suddenly ceased, the wound-up coil spring is gradually loosened. Therefore, a spring force stored in the coil spring is gradually transmitted to the rotary decoration 5 and the decoration rotates for a period of time due to inertia.

Therefore, even if a drive pulse for rotating in the reverse direction is suddenly outputted so as to reverse the rotational direction of the rotary decoration, the rotary decoration maintains its original rotational direction for a short time period by virtue of its inertia. Therefore, the rotational driving force of the stepping motor and the inertial force derived from the coil spring acting in the reverse direction interfere with each other. This produces a visually awkward swing movement in the decoration.

Figure 7:
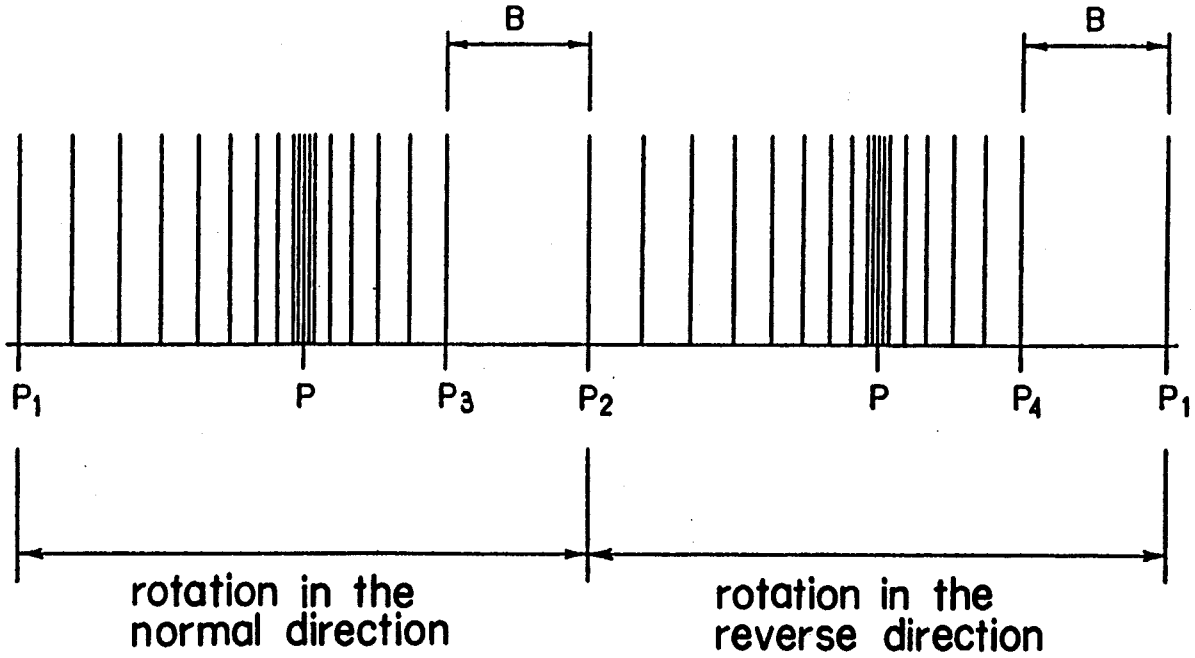
FIG. 7 is a waveform chart showing drive pulses in accordance with a third embodiment of the present invention.

In order to solve this problem, in the third embodiment of the present invention, as shown in FIG. 7, drive pulses are not outputted over a predetermined region B immediately before the rotary decoration 5 changes its rotational direction. That is, there is a no-pulse generating region prior to the rotary decoration 5 changing its rotational direction.

Figure 6:
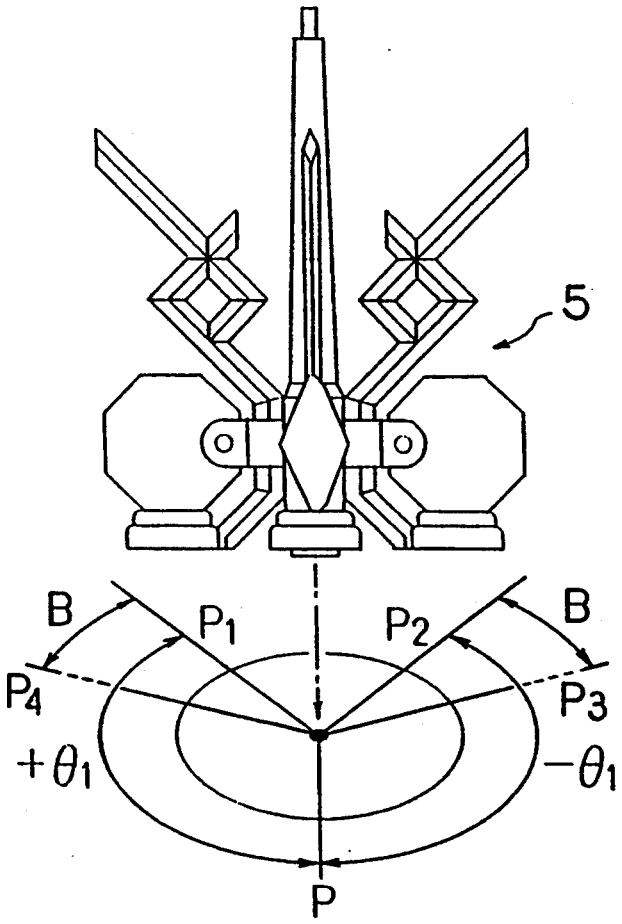
FIG. 6 is another explanatory view showing the relationship between the rotary decoration member and its rotational angle.

Accordingly, just before the rotary decoration 5 reaches this no-pulse generating section (i.e., the position $P_3$ or $P_4$ in FIG. 6), the wound up coil spring is gradually loosened and the rotary decoration rotates by virtue of its inertia. The loosened coil spring is wound up again in accordance with this inertial rotation. At the end of this rewinding-up operation, a drive pulse is inputted to the stepping motor.

In this manner, there is no interference between the rotational driving force of the step motor and the inertia derived from the coil spring acting in the reverse direction. Therefore, when the rotary decoration initiates its swing movement in a reverse direction, the rotary decoration 5 exhibits an elegant swing motion, since the coil spring is completely wound up.

Figure 8:
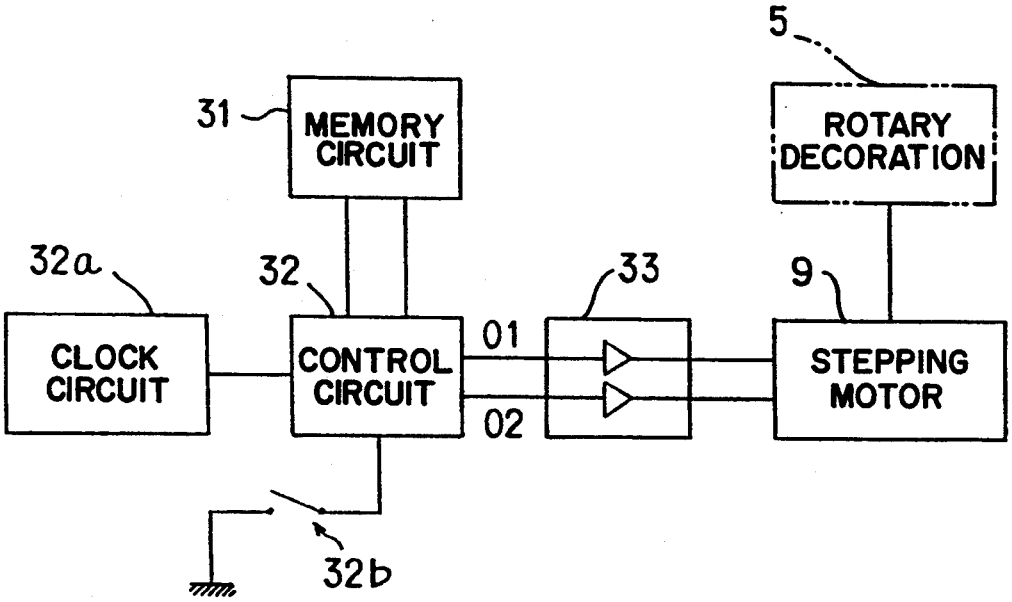
FIG. 8 is a block diagram showing a circuit configuration of a drive unit in accordance with the present invention.

FIG. 8 is a block diagram showing a circuit configuration of the present invention. A memory circuit 31 comprising, e.g., a ROM, stores data used for generating the above-described drive pulses, and is connected to a control circuit 32 comprising, e.g., a CPU. The control circuit 32 specifies an address in the memory circuit 31 and reads in a numerical value from this specified address corresponding to the pulse interval via a data bus. The control circuit 32 is connected to a clock circuit 32*a* for controlling the drive pulse timing, and connected to a reset switch 32*b* for resetting the control circuit 32. The control circuit 32 has two separate outputs, one (01) for rotating the motor in the forward direction, and the other (02) for rotating the motor in the reverse direction. The outputs 01, 02 are each connected to a motor driving circuit 33 that contains respective output buffers. The motor driving circuit 33 is constituted in such a manner that drive pulses are outputted to the stepping motor 9 in accordance with the pulse intervals outputted from the control circuit 32.

When the rotary decoration 5 is actuated, the control circuit 32 specifies an address in the memory circuit 31, which address corresponds to a starting operation of the rotary decoration 5. A numerical value representative of a drive pulse interval is read in via the data bus, and then forward-rotation drive pulses for causing rotational motion in the forward direction are supplied from the control circuit 32 to the motor driving circuit 33. The stepping motor 9 steps in the forward direction in accordance with the drive pulses for forward rotation sent by the driving circuit 33.

Figure 9:
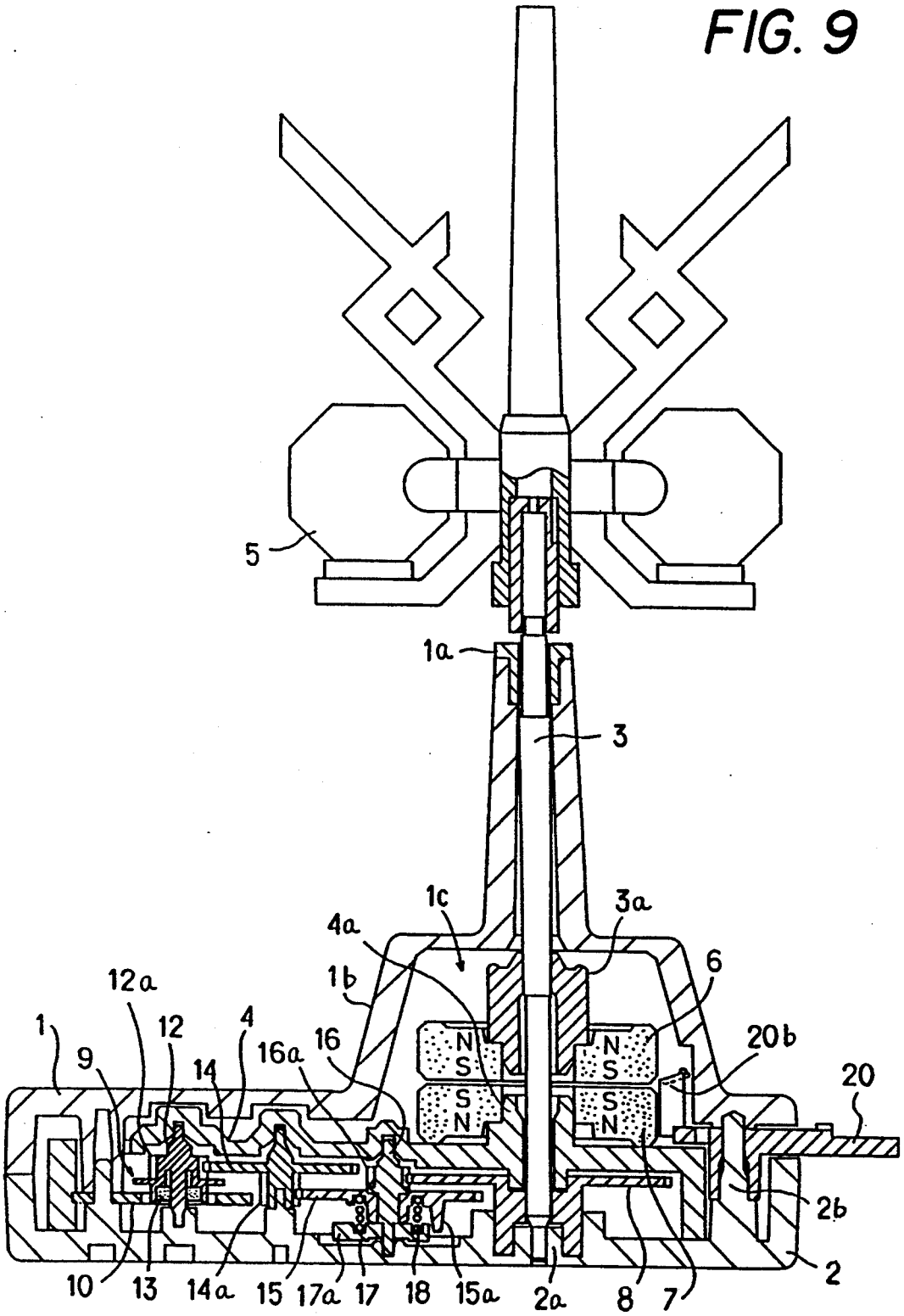
FIG. 9 is a cross-sectional view showing the specific configuration of essential parts in accordance with the present invention.

With reference to FIG. 9, the rotational movement of the stepping motor 9 is transmitted from a rotor 12 to gears 14, 15. A coil spring 18 is wound and charged with spring force by the rotation of the gear 15. Then, by the spring force stored in the coil spring 18, a disk 17 is turned and a rotary shaft 3 is driven in the direction of forward rotation through a transmission shaft 16 and a driving gear 8. As the rotational force is transmitted through the coil spring 18 in this manner, the rotational torque is smoothly transmitted to the disk 17, the driving gear 8, and the rotary shaft 3, even if the gear 15 is intermittently rotated to cause step motion. Thus, the rotary decoration 5 can be driven smoothly in a direction of forward rotation.

In this manner, the pulse signal is read out successively so as to have a drive timing corresponding to the rotational angle of the rotary decoration 5, so that the motor rotates to cause the rotary decoration 5 to swing in a forward swing direction. When the rotary decoration 5 has rotated by an amount equal to one-half its maximum angle of rotation, the control circuit 32 begins supplying reverse-rotation drive pulses to the motor driving circuit 33 on the basis of subsequently inputted data so that the motor rotates in the reverse direction. Then the rotary decoration 5 is swung in the opposite direction by an amount corresponding to the maximum angle of rotation after which the rotary decoration 5 is swung in the forward direction by an amount corresponding to the maximum angle of rotation. This forward-reverse cycle is repeated and the rotary decoration 5 is driven with a reciprocative rotation.

Next, a driving device for the rotary decoration that embodies the present invention is explained.

Figure 10:
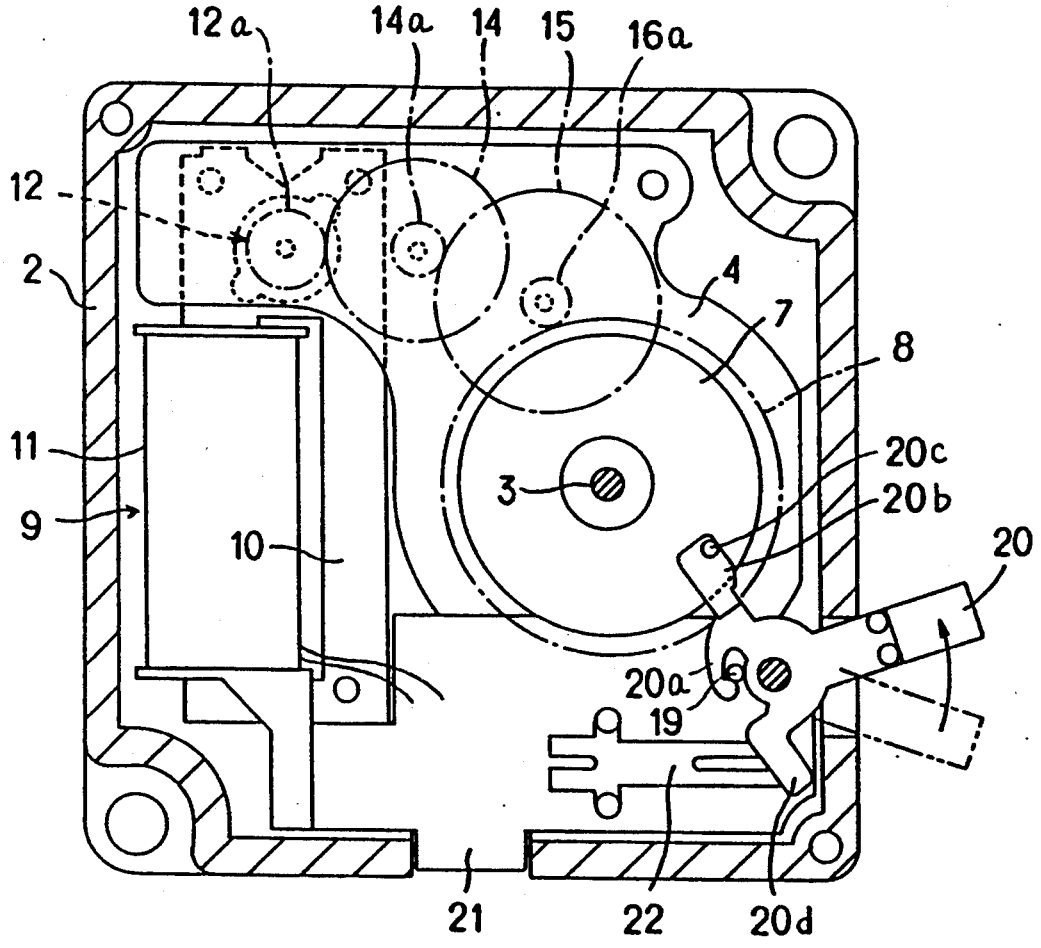
FIG. 10 is a cross-sectional plane view showing the specific configuration of essential parts in accordance with the present invention.

As shown in FIGS. 9 and 10, the rotary shaft 3 is rotatably supported vertically by an upper case 1 and a lower case 2, and further pivotally supported at bearing portions 1*a* and 2*a* thereof. The rotary shaft 3 extends through the center of a protrusion 4*a* of a middle plate 4. The rotary decoration 5 is secured on a protruding edge of the rotary shaft 3, which extends upward out of the upper case 1. A bushing 3*a* is secured on the rotary shaft 3 between the upper case 1 and the middle plate 4. A movable permanent magnet 6 is secured on the bushing 3*a*. A stationary permanent magnet 7 is secured on the protrusion 4*a* of the middle plate 4, so as to oppose the lower face of the permanent magnet 6. The two permanent magnets 6, 7 are magnetized to mutually repel each other at their confronting surfaces to establish a magnetic floating mechanism between the two permanent magnets 6,7 in such a manner that both permanent magnets oppose each other through a predetermined gap in a non-contact condition when the rotary decoration 5 is mounted on the rotary shaft 3.

The drive gear 8 is connected downward from the middle plate 4 with the protruding portion of the rotary shaft 3, so as to be slidable in an axial direction of the rotary shaft 3 but not to rotate with respect to the rotary shaft 3. A rotational force of the stepping motor 9, which serves as a driving source, is transmitted to the driving gear 8. A drive coil 11 is wound around one leg piece of a stator 10, which is substantially formed in a U-shape. A rotor 12 is rotatably supported between the lower case 2 and the middle plate 4 in a gap provided at a front edge of the stator 10. A permanent magnet 13 secured on the rotor 12 receives a rotational force by being magnetically coupled with the stator 10.

A rotor pinion 12*a* meshes with the gear 14, and a pinion 14*a* of the gear 14 meshes with the gear 15. The gear 15 is rotatably engaged with the transmission shaft 16. A pinion 16*a* integrally formed with the transmission shaft 16 meshes with the driving gear 8. With this arrangement, the transmission gear train is configured to transmit motion from the stepping motor 9 to the driving gear 8. The gears 15 and 16 are both rotatably supported between the lower case 2 and the middle plate 4.

Though the gear 15 is rotatably supported by the transmission shaft 16, the lower end portion of the transmission shaft 16 is press-fitted into a through-hole on the disk 17 so that the gear 15 is retained so as not to be removed from the transmission shaft 16. The coil spring 18 is interposed between the gear 15 and the disk 17, and an upper end of the coil spring 18 is fixed to the gear 15 while a lower end of the coil spring 18 is fixed to the disk 17.

On the lower surface of the gear 15, a protrusion 15*a* is integrally formed to extend downward to closely approach the outer peripheral portion of the disk 17. On the outer peripheral portion of the disk 17, a protrusion 17*a* is provided to partly protrude in a radial direction. When the coil spring 18 is in a free (neutral) condition, the protrusion 15*a* and the protrusion 17*a* are positioned so as to oppose each other. The protrusion 15*a* and the protrusion 17*a* do not engage each other during normal operation. Only when the coil spring 18 is excessively wound up, or when the coil spring 18 is excessively loosened, do the protrusions 15*a* and 17*a* act to prevent the coil spring 18 from being damaged.

A lock lever 20 is pivotally supported on a protrusion 2*b*, which protrudes from the lower case 2 adjacent to the permanent magnets 6, 7. A click arm 20*a* formed in an arc-shape, a locking arm 20*b* having a slant surface and extending in a radial direction, and a protrusion 20*c* protruding on the upper surface of the locking arm are integrally formed together with the lock lever 20. The locking arm 20*b* is capable of entering between the permanent magnets 6 and 7 and is operable to lift the permanent magnet 6 upward by its slant surface. A reset arm 20*d* extends outwardly in a radial direction from the lock lever 20.

Beneath the reset arm 20*d*, there is provided a printed circuit board 21, and both ends of the drive coil 11 are connected to predetermined positions on the circuit board 21. A spring plate 22 constitutes the reset switch 32*b* for resetting the control circuit 32 as explained above with reference to FIG. 8. The spring plate 22 is positioned such that it confronts an edge portion of the reset arm 20*d* on the printed circuit board 21. A click pin 19 is formed on and protrudes from the printed circuit board 21. The click arm 20*a* can move beyond the click pin 19.

The above-described transmission gear train is accommodated between the lower case 2 and the middle plate 4 and, therefore, it becomes possible to form the overall drive unit in a thin configuration. The portion of the drive unit housing the permanent magnets 6, 7, i.e., the portion containing the magnetic floating mechanism, is thicker in an up-and-down or vertical direction in FIG. 9 as compared with the portion housing the transmission gear train. Therefore, the upper case 1 is formed with a protrusive portion 1*b* in a predetermined location about the rotary shaft 3. The magnetic floating mechanism including the permanent magnets 6, 7 is housed in a space 1*c* formed by the protrusive portion 1*b*. If it is assumed that the maximum angle of rotation or angular displacement of the rotary decoration 5 is $2\cdot\theta_1$, the angular velocity $\omega$ of the rotary decoration 5 is greatest when the rotary decoration 5 is positioned to face forward (position P in FIG. 1), i.e., when its rotational angle is $\theta_1$. The angular velocity $\omega$ of the rotary decoration 5 is smallest when the rotary decoration 5 is positioned at either of the right and left ends (positions $P_1$, $P_2$ in FIG. 1). Accordingly, the pulse interval d between the drive pulses is set to the minimum interval $d_{min}$ when the angular velocity $\omega$ is greatest. Conversely, the pulse interval d between the drive pulses is set to the maximum interval $d_{max}$ when the angular velocity $\omega$ is least. Also, the pulse interval d between the drive pulses is changed to decrease from the maximum interval $d_{max}$ to the minimum interval $d_{min}$. In addition, the pulse interval d between the drive pulses is changed to increase from the minimum interval $d_{min}$ to the maximum interval $d_{max}$.

When the rotary decoration 5 is actuated, the control circuit 32 (FIG. 8) specifies the address in the memory circuit 31, which address corresponds to the starting operation of the rotary decoration 5. A numerical value representative of the pulse interval is read in via the data bus, and then drive pulses causing rotational movement in the forward or normal direction are supplied from the control circuit 32 to the motor driving circuit 33. The stepping motor 9 steps in accordance with the drive pulses supplied at a predetermined driving interval. The rotational motion of the stepping motor 9 is transmitted from the rotor 12 to the gears 14, 15 (FIGS. 9 and 10). The spring force of the coil spring 18 is stored by the rotation of the gear 15. Then the disk 17 is turned, and the rotary shaft 3 is driven in the direction of forward rotation through the transmission shaft 16 and the driving gear 8 by the spring force stored in the coil spring 18. Because the rotational force is transmitted through the coil spring 18 in this manner, the rotational torque is smoothly transmitted to the disk 17, the driving gear 8, and the rotary shaft 3, even if the gear 15 is intermittently rotated so as to cause stepping. Thus, the rotary decoration 5 can be driven smoothly in the forward direction of rotation.

As is apparent from the foregoing description, the present invention provides embodiments in which:

(1) The pulse intervals are set at short, equal intervals in a predetermined location over the middle region of the predetermined angular displacement of the rotary decoration in one direction. Therefore, the rotary decoration is gradually accelerated in the direction of its forward rotation, is driven at a constant speed in the middle region, and is gradually decelerated after it passes this middle region. Accordingly, it becomes possible to impart an elegant and speedy motion to the rotary decoration.

Further, as there is no need for generating numerous drive pulses within a short period of time, it becomes possible to adequately increase the rotation cycle without decreasing the life of the battery. Furthermore, since the rotary decoration is driven to change its speed according to a sine curve without using a conventional balance-wheel driving mechanism which requires a hairspring, it becomes possible to provide various products (for example, a clock) adopting a rotary decoration at low cost.

(2) The pulse intervals are set short in a predetermined region immediately after the rotary decoration has changed its rotational direction. By outputting drive pulses in a short period of time by an amount required for unwinding the wound coil spring and then re-winding it, it becomes possible to promptly wind up the coil. As a result, the rotary decoration is prevented from stopping at the time when the rotational direction of the rotary decoration is changed. Thus, an elegant swing motion is imparted.

(3) No drive pulses are outputted in a predetermined region immediately before the rotary decoration changes its rotational direction. That is, there is a no-pulse generating region provided immediately before the rotary decoration changes its rotational direction. Accordingly, just prior to when the rotary decoration reaches this no-pulse generating section, the wound up coil spring is gradually loosened to gradually impart the force accumulated in the coil spring to the decoration, which continues to rotate by virtue of its inertia. Thus, it becomes possible to impart an elegant swing motion to the rotary decoration.

We claim:

1. A drive unit for a rotary decoration comprising:

a stepping motor capable of rotating in both forward and reverse directions in response to drive pulses applied thereto for reciprocally driving a rotary decoration through a predefined angular displacement;

a memory circuit for storing drive timing data for said stepping motor; and a control circuit for controlling said stepping motor on the basis of the data stored in said memory circuit;

said data comprises numeralized values representing pulse intervals between the drive pulses of said stepping motor so that the rotational speed of said rotary decoration can vary in conformity with a sine curve; and said pulse intervals occurring in a predetermined middle region defined about a midpoint of a unidirectional angular displacement rotation of said rotary decoration and being equally spaced in time relation and smaller than pulse intervals occurring in other regions of the angular displacement.

2. A drive unit for a rotary decoration comprising:

a stepping motor capable of rotating in both forward and reverse directions in response to drive pulses applied thereto for reciprocally driving a rotary decoration through a predefined angular displacement;

a memory circuit for storing drive timing data for said stepping motor; and a control circuit for controlling said stepping motor on the basis of the data stored in said memory circuit;

said data comprises numeralized values representing pulse intervals between the drive pulses of said stepping motor so that the rotational speed of said rotary decoration can vary in conformity with a sine curve; and said pulse intervals occurring in a predetermined region immediately after changing the rotational direction of said rotary decoration and being smaller than other pulse intervals occurring in other regions of the angular displacement.

3. A drive unit for a rotary decoration comprising:

a stepping motor capable of rotating in both forward and reverse directions in response to drive pulses applied thereto for reciprocally driving a rotary decoration through a predefined angular displacement;

a memory circuit for storing drive timing data for said stepping motor; and a control circuit for controlling said stepping motor on the basis of the data stored in said memory circuit;

said data comprises numeralized values representing pulse intervals between the drive pulses of said stepping motor so that the rotational speed of said rotary decoration can vary in conformity with a sine curve; and said data providing a blank pulse region in which no drive pulses are applied to the stepping motor, the blank pulse region occurring in a predetermined region immediately before the rotational direction of said rotary decoration is changed.

4. A drive unit for turning a member about its axis, comprising:

turning means responsive to drive pulses applied thereto for turnably displacing a member about its axis through a predetermined angular displacement alternately in both forward and reverse directions;

driving means for applying drive pulses separated by time intervals to the turning means to effect turning displacement thereof;

storing means for storing timing data representative of durations of the time intervals between applications of drive pulses to the turning means; and controlling means for controlling the time intervals between drive pulses applied to the turning means on the basis of the timing data stored in the storing means to thereby cause the rotational speed of the turning means to vary in conformity with a sine curve.

5. A drive unit according to claim 4; wherein the storing means stores timing data which causes the duration of the time intervals between applications of drive pulses in a region of the predetermined angular displacement centrally defined about a midpoint of the predetermined angular displacement to be short in relation to the duration of the time intervals between applications of drive pulses in other regions of the predetermined angular displacement and which causes the time intervals to be evenly spaced within the defined region.

6. A drive unit according to claim 4; wherein the storing means stores timing data which causes the=duration of the time intervals between applications of drive pulses in a region of the predetermined angular displacement defined from a point immediately following reversal of the direction of turning of the member to be short in relation to the duration of the time intervals between applications of drive pulses in regions of the predetermined angular displacement preceding and following the defined region.

7. A drive unit according to claim 4; wherein the storing means stores timing data which prevents the application of drive pulses to the turning means in a region of the angular displacement defined from a point preceding a reverse point, where the direction of turning of the member is reversed, to the reverse point itself.

8. A drive unit according to claim 4; wherein the turning means comprises a motor.

9. A drive unit according to claim 4; wherein the storing means comprises a memory circuit.

10. A drive unit according to claim 9; wherein the memory circuit comprises a ROM.

11. A drive unit according to claim 4; wherein the turning means comprises a stepping motor; and the driving means comprises a motor driving circuit.

12. A drive unit according to claim 4; wherein the controlling means comprises an electrical control circuit.

13. A drive unit for turning a member, comprising:

turning means for applying a turning force to a member to reciprocatively swing the member through a predetermined angular displacement, the predetermined angular displacement having a first endpoint, a middle portion and a second endpoint;

driving means for driving the turning means so as to reciprocatively swing the member through the predetermined angular displacement; and controlling means for sequentially generating a series of drive pulses and applying the same to the driving means to effect driving of the turning means, wherein adjacent drive pulses are separated by respective time intervals having a duration, and wherein the series of drive pulses are applied so that drive pulses applied during a time at the middle portion of the predetermined angular displacement are separated by time intervals having an equal duration which is shorter than a duration of time intervals separating drive pulses applied during a time from an end of the middle portion to the first endpoint and during a time from another end of the middle portion to the second endpoint so that the member is turned to reciprocatively swing through the predetermined angular displacement at an angular speed varying in conformity with a sine curve.

14. A drive unit for turning a member according to claim 13; further comprising storing means for storing timing data representative of the series of drive pulses; and wherein the controlling means includes means for receiving the timing data and for generating the series of drive pulses in response thereto.

15. A drive unit for turning a member according to claim 13; further comprising a spring for dampening the turning force applied by the turning means, the spring being alternately loosened and rewound when a turning motion of the member reverses direction at the first endpoint and at the second endpoint; and wherein the controlling means includes means for generating the series of drive pulses so that drive pulses applied during a time immediately after reversal of the turning motion are separated by time intervals each having a duration shorter than a duration of time intervals separating drive pulses applied during the time from the end of the middle portion to the first endpoint and during the time from the other end of the middle portion to the second endpoint so that the spring is loosened and rewound quickly during reversal of the turning motion.

16. A drive unit for turning a member according to claim 15; further comprising storing means for storing timing data representative of the series of drive pulses; and wherein the controlling means includes means for receiving the timing data and for generating the series of drive pulses in response thereto.

17. A drive unit for turning a member according to claim 13; further comprising a spring for dampening the turning force applied by the turning means, the spring exerting an urging force imparting an inertia to the member in a direction opposite the direction of the turning force applied by the turning means to the member to reverse the direction of turning motion of the member at the first endpoint and at the second endpoint; and wherein the controlling means includes means for generating the series of drive pulses so that drive pulses are not applied during a time immediately before reversal of the turning motion so that at least a portion of the inertia imparted by the urging force during the time immediately before reversal of the turning motion is not exerted against the turning force applied by the turning means to reverse the direction of a turning motion.

18. A drive unit for turning a member according to claim 17; further comprising storing means for storing timing data representative of the series of drive pulses; and wherein the controlling means includes means for receiving the timing data and for generating the series of drive pulses in response thereto.

* * * * *